US007658681B1

(12) United States Patent
Malecha

(10) Patent No.: US 7,658,681 B1
(45) Date of Patent: Feb. 9, 2010

(54) GOLF SWING AID APPARATUS

(76) Inventor: August H. Malecha, 79 Chelsea St., Bloomingdale, MN (US) 60108

( * ) Notice: Subject to any disclaimer, the term of this patent is extended or adjusted under 35 U.S.C. 154(b) by 71 days.

(21) Appl. No.: 12/212,366

(22) Filed: Sep. 17, 2008

(51) Int. Cl.
*A63B 69/36* (2006.01)

(52) U.S. Cl. ..... 473/214; 473/276

(58) Field of Classification Search ..... 473/63, 473/207, 212, 214, 266, 276, 450; 602/16
See application file for complete search history.

(56) References Cited

U.S. PATENT DOCUMENTS

| | | | | |
|---|---|---|---|---|
| 3,419,276 | A | 12/1968 | Poggioli | |
| 3,637,219 | A | 1/1972 | Lemon | |
| 3,884,478 | A | 5/1975 | Buzan | |
| 3,900,199 | A | 8/1975 | McGonagle | |
| 4,884,561 | A * | 12/1989 | Letson, Sr. | 602/16 |
| 5,025,782 | A * | 6/1991 | Salerno | 602/16 |
| 5,042,464 | A * | 8/1991 | Skwor et al. | 602/16 |
| 5,048,837 | A * | 9/1991 | Manley et al. | 473/214 |
| 5,107,823 | A * | 4/1992 | Fratesi | 602/16 |
| 5,203,570 | A | 4/1993 | Graham | |
| 5,222,733 | A * | 6/1993 | Brunty | 473/438 |
| 5,445,385 | A | 8/1995 | Brooks | |
| 5,743,806 | A | 4/1998 | Brennan | |
| 5,865,695 | A * | 2/1999 | Mahala et al. | 473/450 |
| D460,824 | S | 7/2002 | Ames | |

* cited by examiner

*Primary Examiner*—Nini Legesse

(57) ABSTRACT

A golf swing aid apparatus includes a first plate and a second plate. Each of the first and second plates has a top side, a first end edge, a second end edge, a first lateral edge and a second lateral edge. The top sides of each of the first and second plates are concavely arcuate. A hinging assembly hingedly couples the first end edge of the first plate to the second end edge of the second plate to substantially align the top sides of the first and second plates when the first and second plates are in an unbent orientation with respect to each other. The hinging assembly allows the first and second plates to bend with respect to each other after a predetermined amount of force is exerted on the hinging assembly. A strap assembly releasably secures the first and second plates to a golfer's arm.

5 Claims, 4 Drawing Sheets

GOLF SWING AID APPARATUS

BACKGROUND OF THE INVENTION

Field of the Invention

The present invention relates to golf swing assisting devices and more particularly pertains to a new golf swing assisting device for training a golfer not to bend their arm while swinging a golf club.

SUMMARY OF THE INVENTION

The present invention meets the needs presented above by generally comprising a first plate and a second plate. Each of the first and second plates has a top side, a bottom side, a first end edge, a second end edge, a first lateral edge and a second lateral edge. The top side of each of the first and second plates is concavely arcuate from the first lateral edges to an associated one of the second lateral edges. A hinging assembly hingedly couples the first end edge of the first plate to the second end edge of the second plate to substantially align the top sides of the first and second plates when the first and second plates are in an unbent orientation with respect to each other. The hinging assembly allows the first and second plates to bend with respect to each other after a predetermined amount of force is exerted on the hinging assembly. A strap assembly is attached to the first and second plates to releasably secure the first and second plates to a golfer's arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
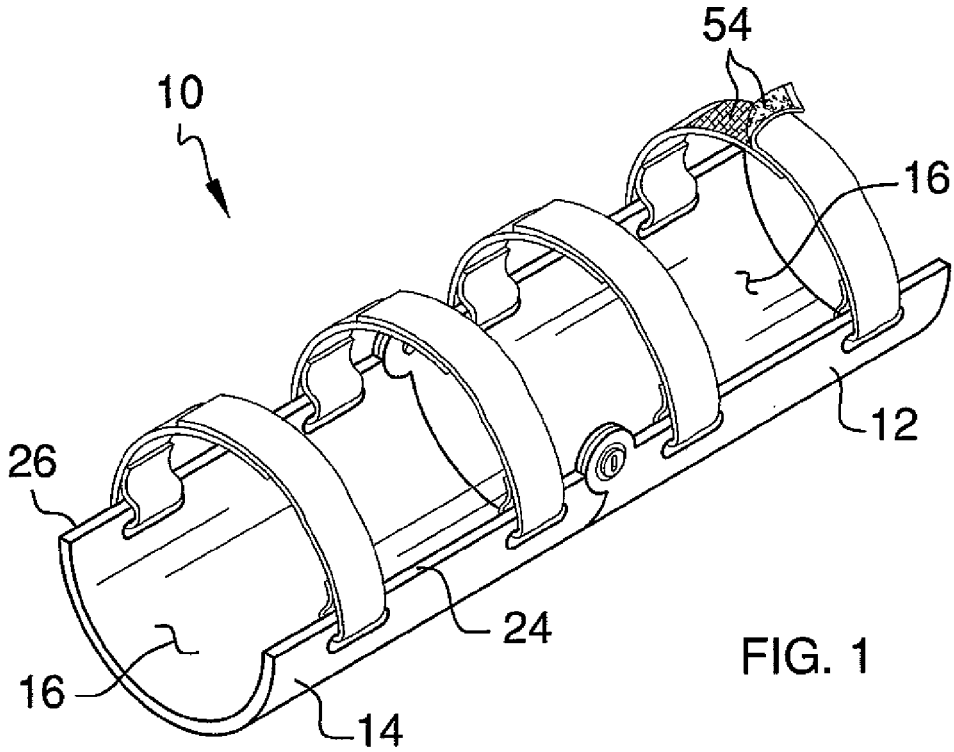
FIG. 1 is a top perspective view of a golf swing aid apparatus according to the present invention.
Figure 2:
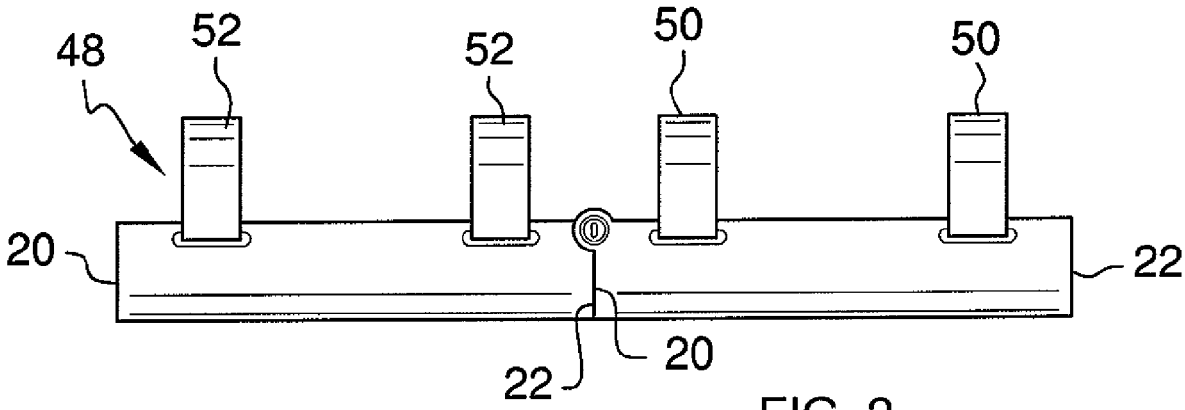
FIG. 2 is a side view of the present invention.
Figure 3:
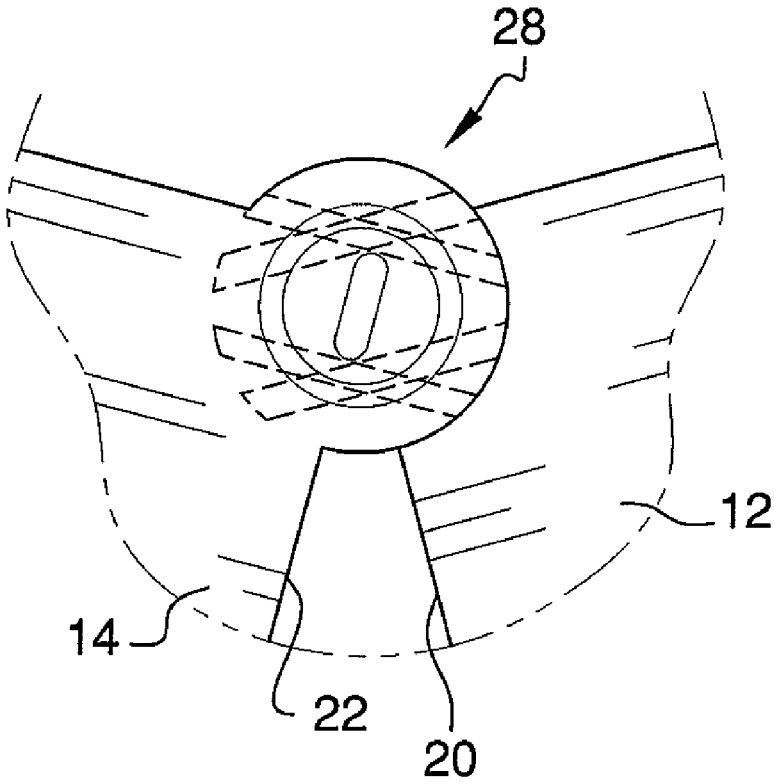
FIG. 3 is a side enlarged view of a hinge assembly of the present invention.
Figure 4:
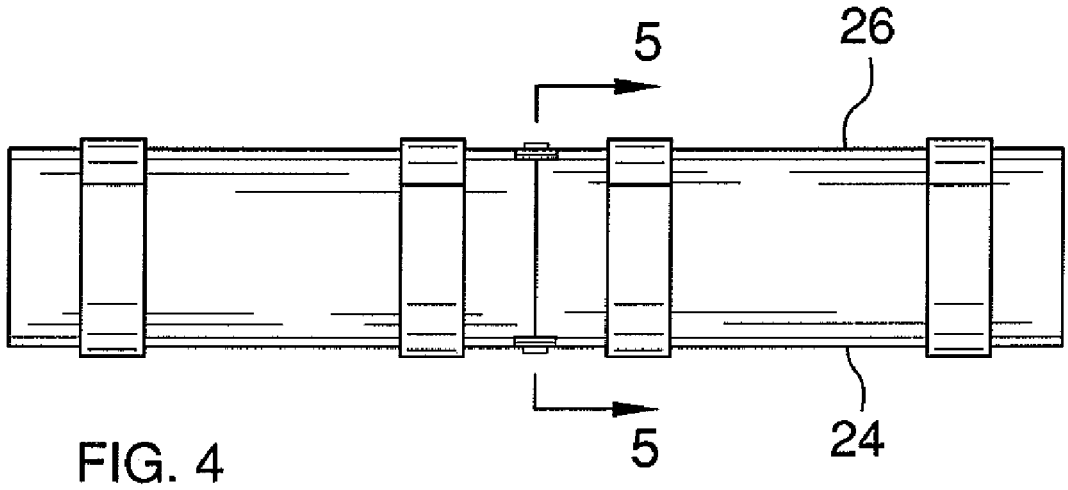
FIG. 4 is a top view of the present invention.
Figure 5:
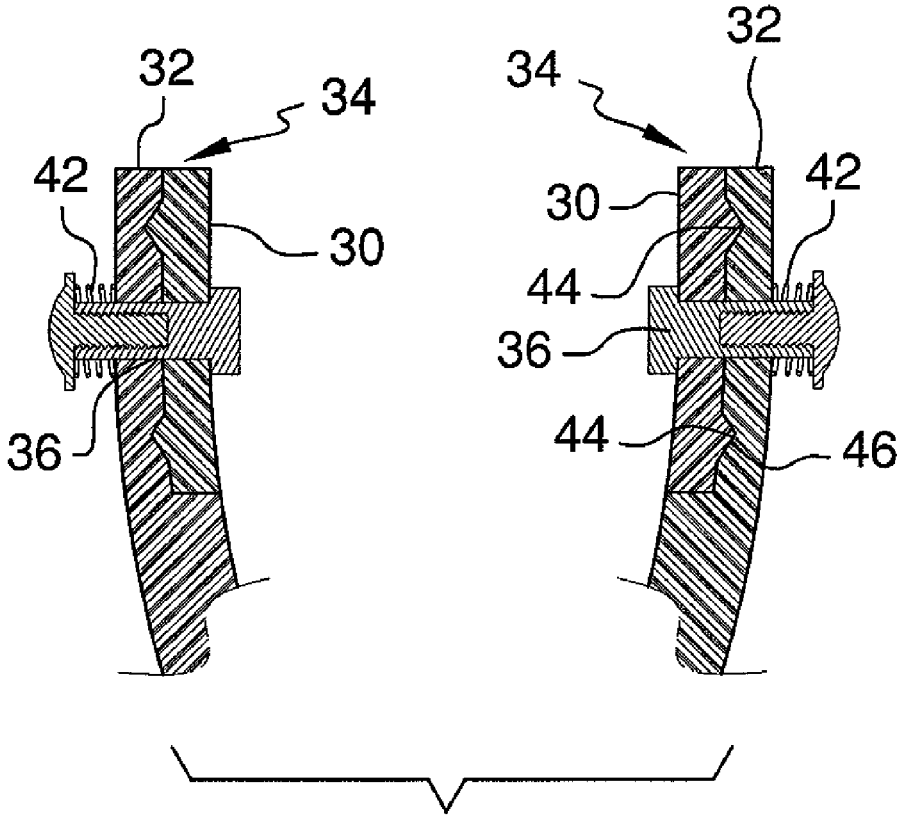
FIG. 5 is a cross-sectional view taken along line 5-5 of FIG. 4 of the present invention.
Figure 6:
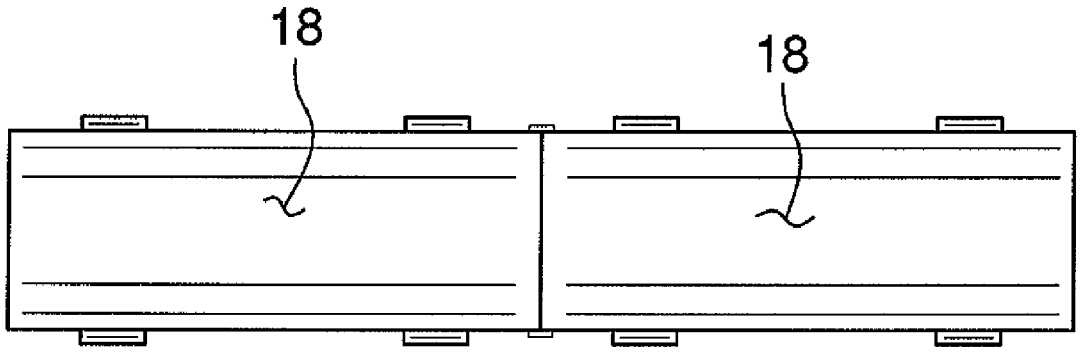
FIG. 6 is a bottom view of the present invention.
Figure 7:
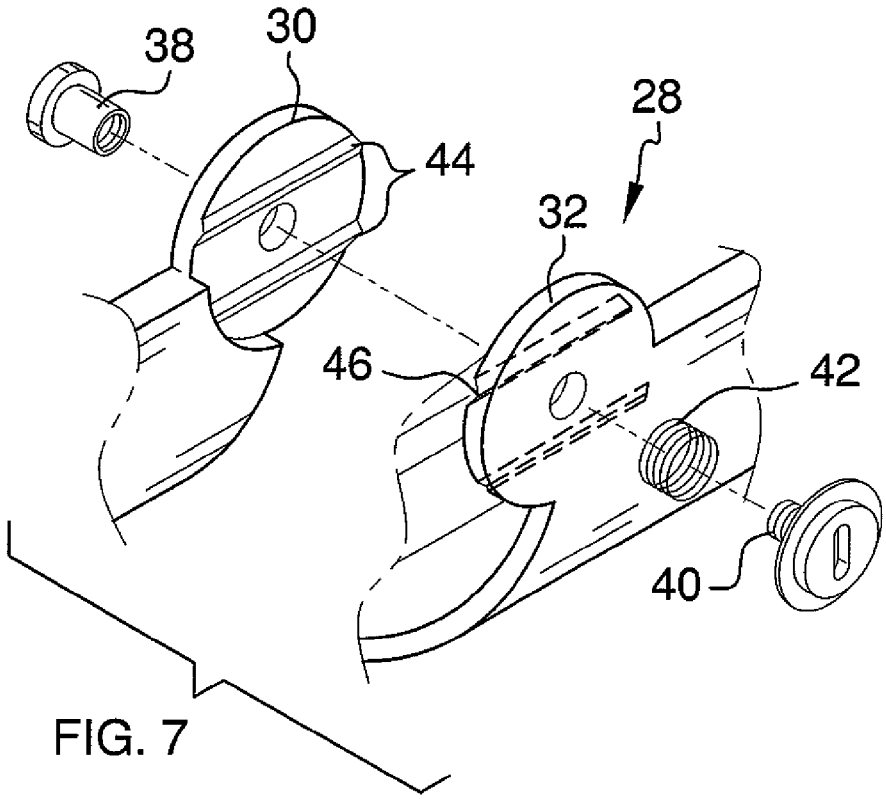
FIG. 7 is an expanded perspective view of the hinge assembly the present invention.
Figure 8:
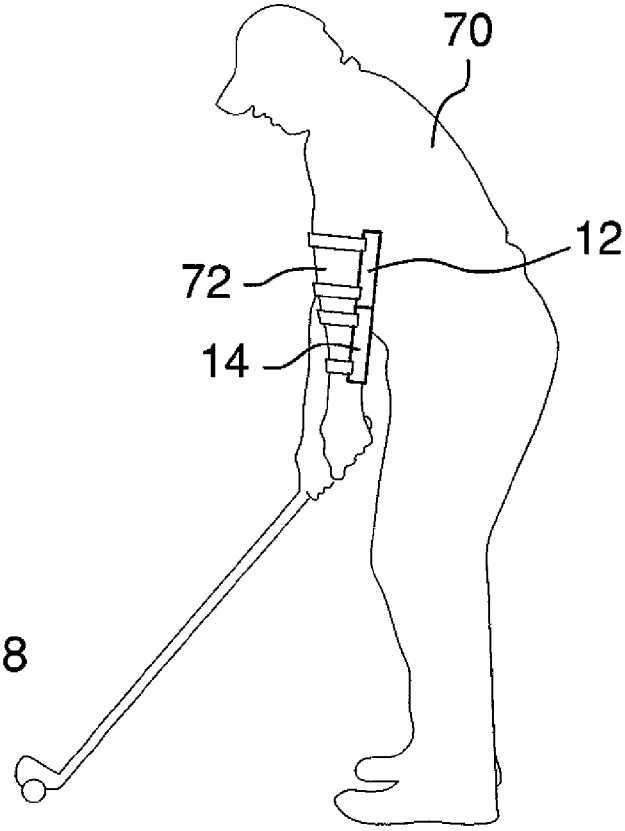
FIG. 8 is a side in-use view of the present invention.

With reference now to the drawings, and in particular to FIGS. 1 through 8 thereof, a new golf swing assisting device embodying the principles and concepts of the present invention and generally designated by the reference numeral 10 will be described.

As best illustrated in FIGS. 1 through 8, the golf swing aid apparatus 10 generally comprises a first plate 12 and a second plate 14. Each of the first 12 and second 14 panels has a top side 16, a bottom side 18, a first end edge 20, a second end edge 22, a first lateral edge 24 and a second lateral edge 26. The top side 16 of each of the first 12 and second 14 panels is concavely arcuate from the first lateral edges 24 to an associated one of the second lateral edges 26.

A hinging assembly 28 hingedly couples the first end edge 20 of the first plate 12 to the second end edge 22 of the second plate 14 to substantially align the top sides 16 of the first 12 and second 14 panels when the first 12 and second 16 panels are in an unbent orientation with respect to each other. The hinging assembly 28 allows the first 12 and second 14 panels to bend with respect to each other after a predetermined amount of force, which is adjustable by the user of the assembly 10, is exerted on the hinging assembly 28. This will teach muscle memory for a golfer 70 to retain the lead arm 72, such as the left arm for a right handed golfer, in a straighter orientation through a swing.

The hinging assembly 28 includes a first pair of panels 30 that are attached to the first plate 12. Each of the first 24 and second 26 lateral edges of the first plate 12 has one panel of the first pair of panels 30 attached thereto. The first pair of panels 30 is positioned adjacent to the first end edge 20 of the first plate 12. A second pair of panels 32 is attached to the second plate 14. Each of the first 24 and second 26 lateral edges of the second plate 14 has one panel of the second pair of panels 32 attached thereto. The second pair of panels 32 is positioned adjacent to the second end edge 22 of the second plate 14. Each panel of the first pair of panels 30 is alignable with and abuttable against one panel of the second pair of panels 32 to define two pairs of mating panels 34 each including one panel from each of the first 30 and second 32 pairs of panels.

A pair of pivot pins 36 is provided. Each of the pairs of mating panels 34 has one of the pivot pins 36 extending therethrough to pivotably couple together associated panels of the mating panels 34. Each of the pivot pins 36 includes a first section 38 threadably coupled to a second section 40 to selectively tighten or loosen a hinged connection between the mating panels 34. A pair of biasing members 42 is also provided. Each of the pivot pins 36 has one of the biasing members 42 thereon and biasing associated panels of the mating panels 34 together. The pivot pins 36 and the biasing members 42 are used to adjust the friction between the panels of the mating panels 34.

At least one panel of the first pair of panels 30 has at least one raised member 44 extendable into at least one depression 46 in at least one of the panels of the second pair of panels 32. The at least one raised member 44 resists the bending of the first 12 and second 14 plates when the at least raised member 44 is positioned in the at least one depression 46. As can be seen from the figures, each of the panels of the first pair of panels 30 may include a pair of elongated raised members 44 and the panels of the second pair of panels 32 would then include a pair of elongated depressions 46. The engagement between the raised members 44 and their corresponding depressions 46 further allows a user of the apparatus 10 to adjust how easily the first 12 and second 14 plates bend with respect to each other.

A strap assembly 48 is attached to the first 12 and second 14 panels to releasably secure the first 12 and second 14 panels to the golfer's arm 72. The strap assembly 48 includes a plurality of straps 50 that are attached to the first plate 12 and extend between the first 24 and second 26 lateral edges thereof. The strap assembly 48 also includes a plurality of straps 52 that are attached to the second plate 14 and extend between first 24 and second 26 lateral edges thereof. The straps 50, 52 may be secured by way of hook and loop fasteners 54.

In use, the first plate 12 is positioned on the lower side of the upper arm and the second plate 14 positioned on the lower side of the forearm. When a golfer 70 swings a golf club, the first 12 and second 14 panels resist bending, or breaking, due to the hinge assembly 28. This trains the golfer 70 to retain the arm 72 in a straight orientation throughout a swing to prevent slicing, hooking and pulled shots. The golfer 70 may adjust the hinge assembly 28 as needed to train the muscles as needed. If the golfer swings and the first plate 12 pivots with respect to the second plate 14, the golfer 70 will know that they have bent their arm 72 and that they may have to tighten the hinge assembly 28 for more rigid training.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf swing aid apparatus, said apparatus being positionable on a golfer's arm to teach the golfer to keep the arm straight, said apparatus comprising:

a first plate and a second plate, each of said first and second plates having a top side, a bottom side, a first end edge, a second end edge, a first lateral edge and a second lateral edge, said top side of each of said first and second plates being concavely arcuate from said first lateral edges to an associated one of said second lateral edges;

a hinging assembly hingedly coupling said first end edge of said first plate to said second end edge of said second plate to substantially align said top sides of said first and second plates when said first and second plates are in an unbent orientation with respect to each other, said hinging assembly allowing said first and second plates to bend with respect to each other after a predetermined amount of force is exerted on said hinging assembly;

a strap assembly being attached to said first and second plates to releasably secure the first and second plates to the golfer's arm;

a first pair of panels being attached to said first plate, each of said first and second lateral edges of said first plate having one panel of said first pair of panels attached thereto, said first pair of panels being positioned adjacent to said first end edge of said first plate;

a second pair of panels being attached to said second plate, each of said first and second lateral edges of said second plate having one panel of said second pair of panels attached thereto, said second pair of panels being positioned adjacent to said second end edge of said second plate, each panel of said first pair of panels being alignable with and abuttable against one panel of said second pair of panels to define two pairs of mating panels each including one panel from each of said first and second pairs of panels;

a pair of pivot pins, each of said pairs of mating panels having one of said pivot pins extending therethrough to pivotably couple together associated panels of said mating panels, each of said pivot pins including a first section threadably coupled to a second section to selectively tighten or loosen a hinged connection between said mating panels;

at least one panel of said first pair of panels having at least one raised member extendable into at least one depression in at least one of the panels of said second pair of panels, said at least one raised member resisting the bending of the first and second plates when said at least raised member is positioned in said at least one depression.

2. The apparatus according to claim 1, wherein said hinging assembly includes:

a first pair of panels being attached to said first plate, each of said first and second lateral edges of said first plate having one panel of said first pair of panels attached thereto, said first pair of panels being positioned adjacent to said first end edge of said first plate;

a second pair of panels being attached to said second plate, each of said first and second lateral edges of said second plate having one panel of said second pair of panels attached thereto, said second pair of panels being positioned adjacent to said second end edge of said second plate, each panel of said first pair of panels being alignable with and abuttable against one panel of said second pair of panels to define two pairs of mating panels each including one panel from each of said first and second pairs of panels;

a pair of pivot pins, each of said pairs of mating panels having one of said pivot pins extending therethrough to pivotably couple together associated panels of said mating panels, each of said pivot pins including a first section threadably coupled to a second section to selectively tighten or loosen a hinged connection between said mating panels.

3. The apparatus according to claim 2, further including a pair of biasing members, each of said pivot pins having one of said biasing members thereon and biasing associated panels of said mating panels together.

4. The apparatus according to claim 1, wherein said strap assembly includes a plurality of straps being attached to said first plate and extending between said first and second lateral edges, said strap assembly including a plurality of straps being attached to said second plate and extending between first and second lateral edges.

5. A golf swing aid apparatus, said apparatus being positionable on a golfer's arm to teach the golfer to keep the arm straight, said apparatus comprising:

a first plate and a second plate, each of said first and second plates having a top side, a bottom side, a first end edge, a second end edge, a first lateral edge and a second lateral edge, said top side of each of said first and second plates being concavely arcuate from said first lateral edges to an associated one of said second lateral edges;

a hinging assembly hingedly coupling said first end edge of said first plate to said second end edge of said second plate to substantially align said top sides of said first and second plates when said first and second plates are in an unbent orientation with respect to each other, said hinging assembly allowing said first and second plates to bend with respect to each other after a predetermined amount of force is exerted on said hinging assembly, said hinging assembly including;

a first pair of panels being attached to said first plate, each of said first and second lateral edges of said first plate having one panel of said first pair of panels attached thereto, said first pair of panels being positioned adjacent to said first end edge of said first plate;

a second pair of panels being attached to said second plate, each of said first and second lateral edges of said second plate having one panel of said second pair of panels attached thereto, said second pair of panels being positioned adjacent to said second end edge of said second plate, each panel of said first pair of panels being alignable with and abuttable against one panel of said second pair of panels to define two pairs of mating panels each including one panel from each of said first and second pairs of panels;

a pair of pivot pins, each of said pairs of mating panels having one of said pivot pins extending therethrough to pivotably couple together associated panels of said mating panels, each of said pivot pins including a first section threadably coupled to a second section to selectively tighten or loosen a hinged connection between said mating panels;

a pair of biasing members, each of said pivot pins having one of said biasing members thereon and biasing associated panels of said mating panels together;

at least one panel of said first pair of panels having at least one raised member extendable into at least one depression in at least one of the panels of said second pair of panels, said at least one raised member resisting the bending of the first and second plates when said at least raised member is positioned in said at least one depression; and a strap assembly being attached to said first and second plates to releasably secure the first and second plates to the golfer's arm, said strap assembly including a plurality of straps being attached to said first plate and extending between said first and second lateral edges, said strap assembly including a plurality of straps being attached to said second plate and extending between first and second lateral edges.

* * * * *

UNITED STATES PATENT AND TRADEMARK OFFICE

CERTIFICATE OF CORRECTION

PATENT NO. : 7,658,681 B1
APPLICATION NO. : 12/212366
DATED : February 9, 2010
INVENTOR(S) : August H. Malecha It is certified that error appears in the above-identified patent and that said Letters Patent is hereby corrected as shown below:

Title Page item 76 should read
August H. Malecha
79 Chelsea St.
Bloomingdale, IL 60108

Signed and Sealed this

Twenty-second Day of June, 2010

David J. Kappos

David J. Kappos
*Director of the United States Patent and Trademark Office*